US007634211B2

(12) United States Patent
Driessen-Olde Scheper et al.

(10) Patent No.: US 7,634,211 B2
(45) Date of Patent: Dec. 15, 2009

(54) TEMPERATURE CONTROL SYSTEM FOR A ROLLER IN AN IMAGE FORMING APPARATUS

(75) Inventors: Lamberdina J. A. M. Driessen-Olde Scheper, Venlo (NL); Theodorus A. G. Heeren, Venlo (NL)

(73) Assignee: OCE-Technologies B.V., Venlo (NL)

( * ) Notice: Subject to any disclaimer, the term of this patent is extended or adjusted under 35 U.S.C. 154(b) by 0 days.

(21) Appl. No.: 11/896,084

(22) Filed: Aug. 29, 2007

(65) Prior Publication Data

US 2008/0056749 A1 Mar. 6, 2008

(30) Foreign Application Priority Data

Aug. 31, 2006 (EP) ..... 06119898

(51) Int. Cl.
*G03G 21/20* (2006.01)

(52) U.S. Cl. ..... 399/94; 219/628

(58) Field of Classification Search ..... 399/69, 399/94, 330, 335; 219/629, 632
See application file for complete search history.

(56) References Cited

U.S. PATENT DOCUMENTS 4,229,644 A 10/1980 Namiki et al.
5,426,495 A 6/1995 Sawamura et al.
6,992,272 B2 * 1/2006 Kitano et al. ..... 219/619
7,280,795 B2 * 10/2007 Kakishima et al. ..... 399/341
7,420,141 B2 * 9/2008 Kitano et al. ..... 219/469

FOREIGN PATENT DOCUMENTS

JP 57-106416 A 7/1982
JP 60-122979 A 7/1985
JP 7-49192 A 2/1995
JP 8-145045 A 6/1996

OTHER PUBLICATIONS

Machine translation of JP08-145045.*

* cited by examiner

*Primary Examiner*—David M Gray
*Assistant Examiner*—Andrew V Do
(74) *Attorney, Agent, or Firm*—Birch, Stewart, Kolasch & Birch, LLP

(57) ABSTRACT

A temperature control system for a roller that is detachably mounted in a frame of an image forming apparatus includes a primary liquid circuit formed in the roller and containing a first liquid and a secondary liquid circuit formed outside of the roller and containing a second liquid. A heat exchanger is arranged to bring the primary and secondary liquid circuits into thermal contact with one another. The heat exchanger includes a first heat exchange member that is in thermal contact with the primary liquid circuit, and a second heat exchange member arranged on the stationary part to be in thermal contact with the secondary liquid circuit. A temperature control device controls the temperature of the second liquid. The first and second heat exchange members form heat transfer surfaces that are opposed to one another to permit heat transfer from one heat exchange member to the other heat exchange member.

10 Claims, 3 Drawing Sheets

TEMPERATURE CONTROL SYSTEM FOR A ROLLER IN AN IMAGE FORMING APPARATUS

CROSS-REFERENCE TO RELATED APPLICATIONS

This nonprovisional application claims priority under 35 U.S.C. § 119(a) on Patent Application No. 06119898.2, filed in the European Patent Office on Aug. 31, 2006, the entirety of which is incorporated herein by reference.

BACKGROUND OF THE INVENTION

1. Field of the Invention

The present invention relates to a temperature control system for a roller that is detachably mounted in a frame of an image forming apparatus. A primary liquid circuit is formed in the roller and contains a first liquid. A secondary liquid circuit is formed outside of the roller and contains a second liquid. A heat exchanger is arranged to bring the primary and secondary liquid circuits into thermal contact with one another and includes a first heat exchange member that is in thermal contact with the primary liquid circuit and projects outwardly from the roller.

2. Description of Background Art

In an image forming apparatus such as a printer, a copier or the like, several types of rollers need cooling or, more generally, temperature control during the image forming process. Such rollers include, for example, cooling rollers in a heat fuse station of a printer or the like, rollers supporting a photoconductor or a developing unit, guide and deflection rollers for image carrier belts, photoconductor drums or other image forming drums such as drums for a direct induction (DI) image forming process, and many more. It is preferable to use a liquid as a coolant or heat transfer medium, because a liquid dissipates more heat in high speed image forming apparatus and provides a more uniform temperature distribution within the roller. However, if the liquid coolant is circulated through the interior of the roller and through an external cooling device in order to permit efficient and uniform cooling, the coolant liquid circuit inside the roller has to be connected to an external circuit through a rotary seal. This makes it more difficult to detach the roller for maintenance or repair purposes or for exchanging the roller. This is particularly cumbersome for rollers that need to be exchanged regularly because their lifetime is shorter than the lifetime of the apparatus as a whole. In particular, there is a risk that coolant liquid leaks out when the roller is disconnected from or connected to the external circuit.

JP 60-122979 A discloses a temperature control system of the type indicated above, which has the advantage that the coolant may be permanently enclosed in an internal liquid circuit of the roller, so that it will not leak out when the roller is detached. In a preferred embodiment disclosed in this document, the heat exchanger is simply formed by cooling fins projecting from the roller, and the secondary or external coolant medium is simply formed by air that is blown against the cooling fins. Although this document mentions also the possibility that the secondary coolant medium may be a liquid, it does not disclose how a secondary liquid circuit could be configured so as to permit easy detachment of the roller. If the liquid of the secondary coolant circuit is to flow past the cooling fins of the roller, then there is still the problem that the liquid has to be sealed against the detachable roller.

JP-A-07049192 discloses a roll equipment and heating means for heating a hollow, rotating cylinder shaft of the roll equipment. The cylinder shaft has an end portion that is rotatably received in a heater, so that the end portion of the cylinder is heated by the heater. The cylinder shaft further contains a working liquid for distributing the heat in the cylinder.

SUMMARY OF THE INVENTION

It is an object of the present invention to provide a temperature control system that efficiently controls the temperature of the roller and nevertheless permits easy and quick detachment and re-installation of the roller.

According to the present invention, a temperature control system for a roller that is detachably mounted in a frame of an image forming apparatus comprises:

a primary liquid circuit formed in the roller and containing a first liquid;

a secondary liquid circuit formed outside of the roller and containing a second liquid, the secondary liquid circuit being defined inside of a stationary part that is stationary relative to the frame, said secondary liquid circuit being enclosed in said stationary part so as to be separated from the roller;

a heat exchanger arranged to bring the primary and secondary liquid circuits into thermal contact with one another, said heat exchanger comprising a first heat exchange member that is in thermal contact with the primary liquid circuit and projects outwardly from the roller and a second heat exchange member arranged on the stationary part to be in thermal contact with the secondary liquid circuit; and a temperature control device for controlling the temperature of the second liquid, wherein the first and second heat exchange members form heat transfer surfaces that are opposed to one another to permit heat transfer from one heat exchange member to the other heat exchange member.

In this system, the liquid of the secondary liquid circuit is temperature-controlled directly and is permanently enclosed inside of the stationary part and is thus separated from the roller, so that the roller may be detached without difficulty. An efficient heat transfer is assured by the two opposed heat transfer surfaces of the two separate members of the heat exchanger, so that the temperature of the first liquid and of the roller can be controlled indirectly.

The term "roller", as used in this specification, designates a member or assembly that may be detached from the apparatus as a unit and includes at least one rotating component. If the roller includes also a stationary component, e.g. a stationary axle that supports a rotating drum, the first heat exchange member is preferably provided on the stationary member of the roller. In that case, the first and second heat transfer surfaces of the heat exchanger may be in direct contact with each other.

Optionally, a compensation member such as a metallic wire mesh or an indented metal sheet having a good thermal conductivity may be firmly interposed between the two heat transfer surfaces, so that a possible misalignment of the roller, manufacturing tolerances and the like, may be compensated for. A heat conductive paste, e.g. a paste including silver powder, may be used for further improving the thermal contact between the two heat transfer surfaces or between the compensation member at each of the heat transfer surfaces.

If the roller has a stationary axle, the first heat exchange member is preferably formed by at least one end portion of that axle. The primary liquid circuit may be defined by an annular space formed between the axle and the walls of a hollow drum of the roller that is rotatably supported on the axle. Thermal contact between the liquid in the primary liquid circuit and the first heat exchange member may be established by the heat conductivity of the axle. Optionally, the primary liquid circuit may also extend into the interior of the axle, so that the liquid may circulate directly through the first heat exchange member.

The first liquid may be caused to circulate in the primary circuit by any known means, e.g., a pump that is integrated in the roller. Such means may also be formed by impeller blades formed in the rotating member or drum of the roller and possibly also on the stationary axle, so that the rotation of the drum may directly be utilized for propelling the liquid. In yet another embodiment, the primary liquid circuit may include passages that extend in a circumferential direction of the roller and include one or more check valves that permit a flow of the liquid through these passages only in one sense. Then, the inertia of the liquid may be utilized to enforce a flow of the liquid when the roller is accelerated or decelerated. If the roller rotates only at a very low speed or is only driven intermittently, with sufficiently long rest periods between the intervals in which the roller is driven, then the flow of the liquid may also be induced by thermal convection that establishes during the rest periods of the roller.

If the roller is arranged to rotate as a unit, i.e. has no stationary component, then the heat transfer surfaces of the first and second heat exchange members will be arranged to rotate relative to one another and to maintain their mutually opposed relationship in spite of the rotation. For example, the heat transfer surfaces may extend in a plane normal to the axis of rotation, or they may be cylindrical surfaces centered on the axis of rotation. In order to avoid friction, the heat exchange surfaces will preferably be separated by a narrow gap, which permits heat transfer through radiation. Optionally, the heat transfer may be promoted by a heat conductive grease or paste-like lubricant in the gap.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

Figure 1:
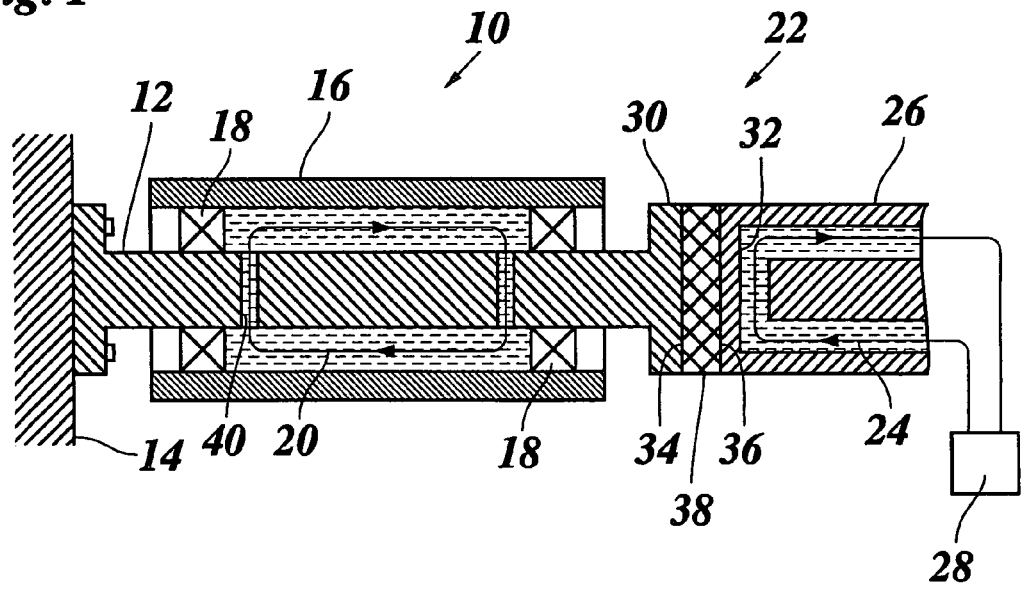
FIG. 1 shows a roller and an associated cooling system in a longitudinal section.

As is shown in FIG. 1, a roller 10 includes a stationary axle 12 that is rigidly and detachably flanged to a frame 14 of an image forming apparatus. A cylindrical drum 16 is rotatably supported on the axle 12 by means of bearings 18. It shall be assumed here that the peripheral wall of the drum 16 or at least the portion between the two bearings 18 needs to be temperature-controlled, e.g. cooled. To that end, the bearings 18 are configured as liquid-tight seals, so that an annular space formed between the two bearings 18 and between the outer peripheral surface of the axle 12 and the inner surface of the drum 16 defines a primary liquid circuit 20 that is filled with a liquid coolant, e.g., water. Thus, the heat generated at or transferred to the surface of the drum 16, e.g., because the drum 16 supports a belt or roller (not shown) that is heated in the course of the image forming process, is transferred from the peripheral wall of the drum 16 to the axle 12 through heat conductivity and/or the flow of the water in the primary liquid circuit 20.

One end of the stationary axle 12 (on the right side in FIG. 1) is connected to a heat exchanger 22, which transfers the heat from the thermally conductive axle 12 onto a secondary liquid circuit 24 that is defined inside of a stationary part 26 of the image forming apparatus, i.e. a part rigidly connected to a portion of the frame 14 that has not been shown here. The secondary liquid circuit 24 contains another coolant liquid, e.g. water, that circulates through the stationary part 26 and a cooling device 28, such as a radiator or an active cooling device (heat pump). The cooling device 28 may also include a pump that causes the liquid to circulate through the circuit 24. The cooling device 28 may be replaced or supplemented by a heating device (not shown), if necessary.

The heat exchanger 22 includes a first heat exchange member 30 formed by a flange at the end of the axle 12. A second heat exchange member 32 is formed by an end wall of the stationary part 26. The second heat exchange member 32 is in direct thermal contact with the secondary liquid circuit 24. The first and second heat exchange members 30, 32 form two parallel heat transfer surfaces 34, 36, that are opposed to one another, so that a heat transfer may occur through radiation and/or heat conduction. In the example shown, the heat transfer surfaces 34, 36 form a gap that is filled by a thermally conductive compensation member 38, e.g. a wire mesh, that compensates for any possible misalignment of the axle 12 of the roller 10. The compensation member 38 may also compensate for any possible deflection of the axle 12 when the drum 16 is subject to a mechanical load. Of course, in a modified embodiment, the compensation member 38 may be dispensed with, and the heat transfer surfaces 34, 36 may be in direct engagement with one another.

Figure 2:
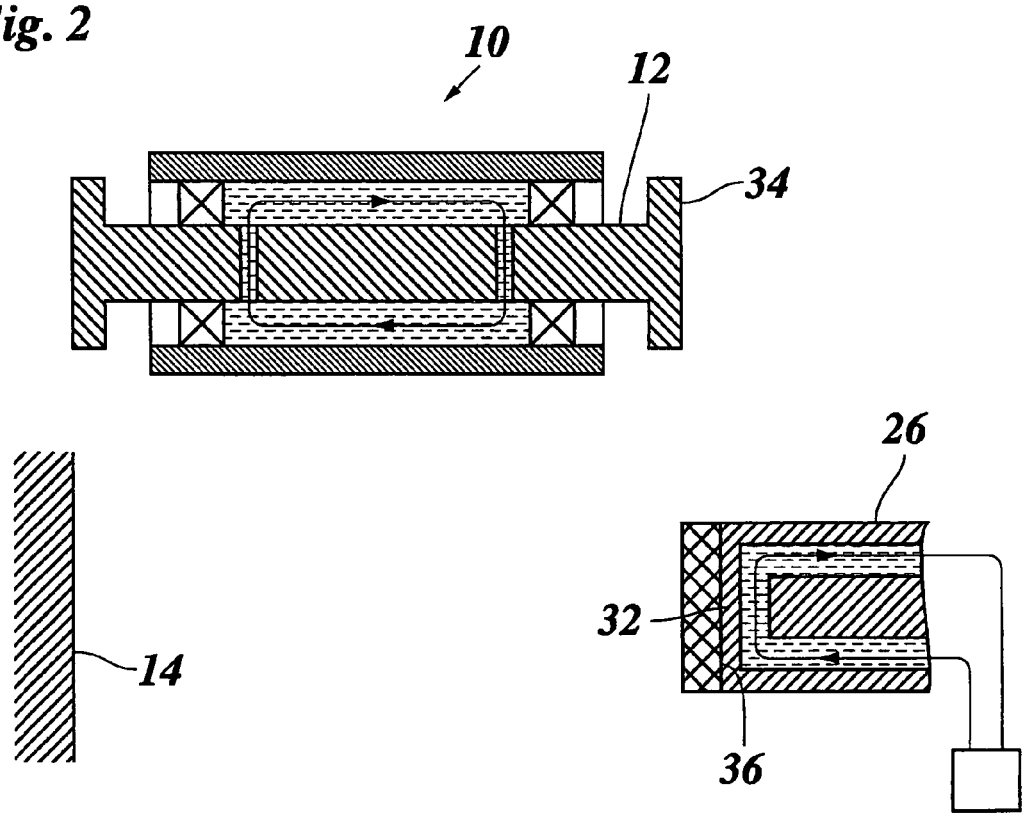
FIG. 2 shows the roller and the cooling system of FIG. 1 in a condition when the roller is detached.

It will be appreciated that the primary liquid circuit 20 is a closed circuit, so that the liquid therein is permanently sealed inside of the roller 10. On the other hand, the secondary liquid circuit 24 may be an open circuit, but is in thermal contact with the roller 10 only through the heat exchanger 22. The liquid contained in the secondary liquid circuit 24 is nowhere in contact with any part of the roller 10. Thus, the roller 10 may easily be detached, as has been shown in FIG. 2, without any risk of leakage of liquid from the primary liquid circuit 20 or the secondary liquid circuit 24.

In the example shown, thermal contact between the primary liquid circuit 20 and the first heat exchange member 30 is established through the heat conductivity of the axle 12, which may be made of metal. Furthermore, the axle 12 is shown to have vertical bores 40 through which the liquid may circulate. Since the axle 12 is stationary, the bores 40 will retain their vertical orientation. The liquid in the left bore 40 in FIG. 1 will be cooled, because heat is dissipated towards the heat exchanger 22. As a result, a convective flow of the liquid will be established, as indicated by arrows in FIG. 1. In addition, the liquid may be stirred by the rotation of the drum 16. Of course, the bores 40 might be dispensed with, because the liquid may also flow around the axle 12 in the annular gap.

Figure 3:
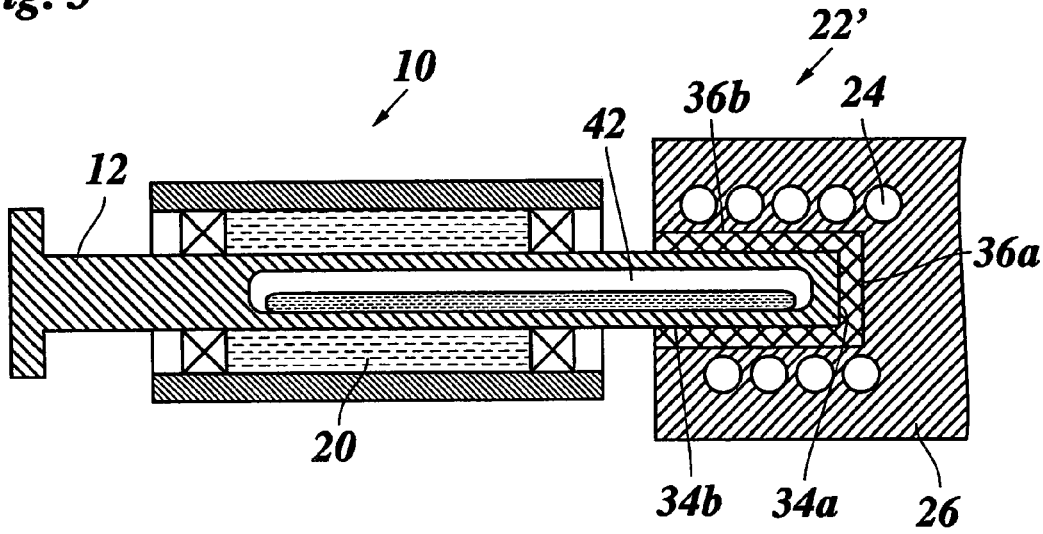
FIG. 3 shows a roller and a cooling system according to another embodiment.

FIG. 3 shows a heat exchanger 22' according to a modified embodiment. Here, the first heat exchange member is formed by a cylindrical end portion of the axle 12 that is inserted into a blind bore in the end of the stationary part 26 that forms the second heat exchange member. Thus, the end face and the peripheral wall of the end portion of the axle 12 form heat transfer surfaces 34*a* and 34*b*, respectively, that are opposed to heat transfer surfaces 36*a* and 36*b*, respectively, formed by the bottom and the internal peripheral wall of the blind bore in the stationary part 26. Again, a gap between the heat transfer surfaces is filled by a thermally conductive compensation member.

The secondary liquid circuit 24 includes helical passages that surround the blind bore in close proximity to the heat transfer surface 36*b*, so that a good thermal contact is achieved when the liquid circulates in the helical passage. In order to improve the thermal contact between the primary liquid circuit 20 and the heat exchanger 22', the axle 12 according to this example accommodates a heat pipe 42.

Figure 4:
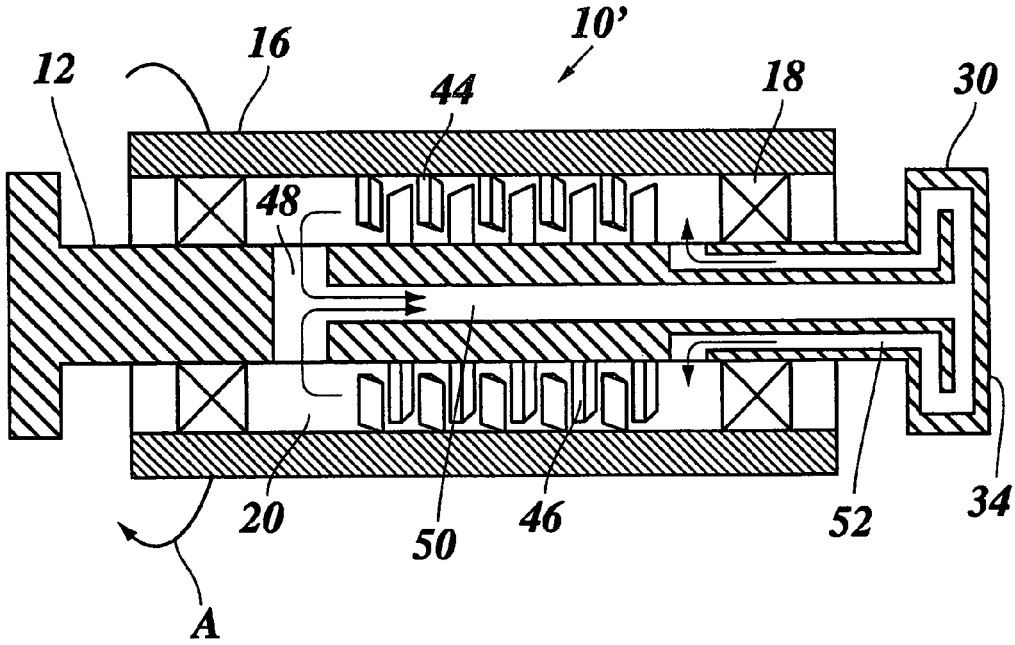
FIG. 4 shows, in an enlarged longitudinal section, a roller according to yet another embodiment.

FIG. 4 shows another example of a roller 10', wherein impeller blades 44 are formed on the inner peripheral wall of the drum 16, and stationary blades 46 are formed on the outer periphery of the axle 12. The impeller blades 44 and the stationary blades 46 are arranged alternatingly and are inclined in opposite directions, so that the water in the primary liquid circuit 20 will be propelled from right to left in FIG. 4 when the drum 16 rotates in the direction indicated by an arrow A. The stationary blades 46 prevent the water from co-rotating with the drum 10 when the latter is driven for a longer period of time.

The primary liquid circuit 20 extends into the interior of the axle 12 through radial bores 48 and a central axial bore 50, which extends into the first heat exchange member 30 that is shaped as a flange, as in FIG. 1. At the end of the axial bore 50 on the right side in FIG. 4, the liquid that has been pumped into the passage of the central axis bore 50 by the blades 44, 46 impinges onto the wall of the first heat exchange member 30 forming the heat transfer surface 34 and is then radially spread into return ducts 52 that open into the annular space between the axle 12 and the drum 16, thus closing the primary liquid circuit 20.

In this embodiment, the coolant in the primary liquid circuit 20 is still permanently enclosed in the roller 10', but is actively pumped through the first heat exchange member 30 of the heat exchanger 22, so that the heat transfer will be improved. Of course, this concept can also be used in combination with the heat exchanger 22' shown in FIG. 3.

Figure 5:
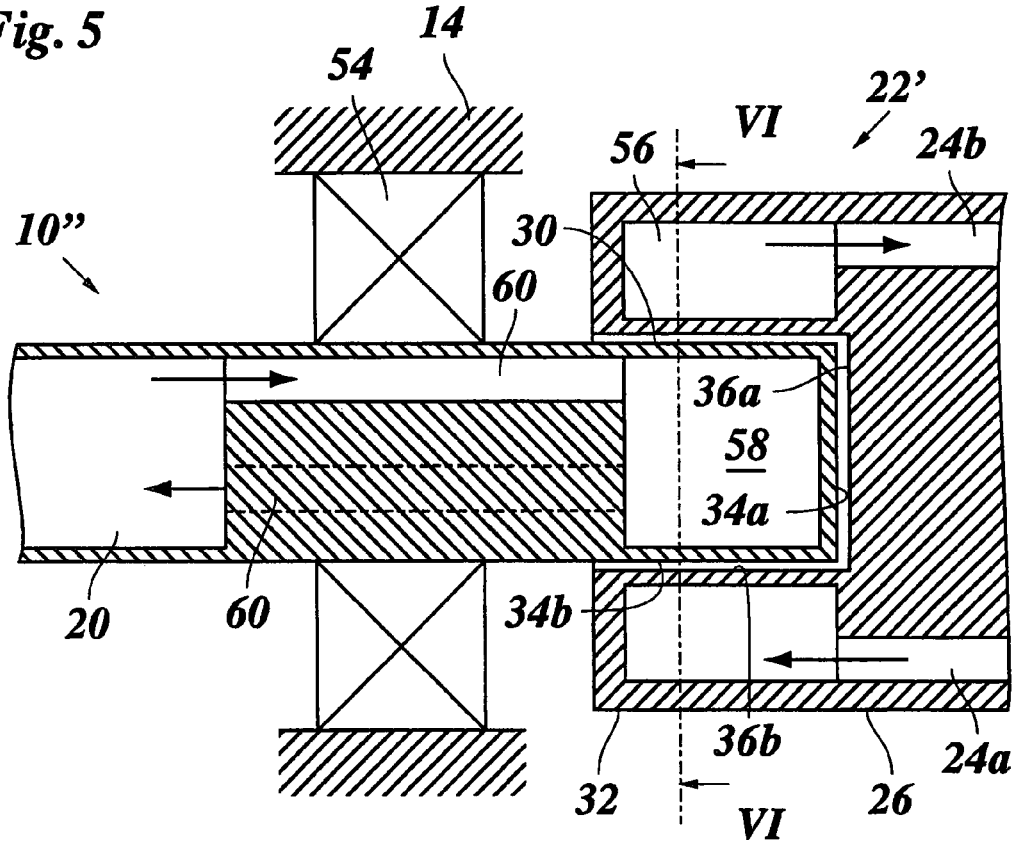
FIG. 5 shows, in longitudinal section, an end portion of a roller and an associated cooling system according to yet another embodiment.

FIG. 5 illustrates an example of a roller 10" that is arranged to rotate as a unit and is rotatably supported in the frame 14 by means of bearings 54. The primary liquid circuit 20 is formed by the hollow interior of the roller 10". The heat exchanger 22' is of the type shown in FIG. 3, that is, the first heat exchange member 30 is formed by an end portion of the roller 10" engaged in a blind bore of the stationary part 26. The gap between the heat transfer surfaces 34*a*, 34*b* and 36*a*, 36*b* is in this case not filled by any member that would cause friction, because the roller 10" rotates relative to the stationary part 26.

The secondary liquid circuit in the stationary part 26 is in this case formed by a lower supply passage 24*a* and an upper supply passage 24*b* that are both connected to an annular chamber 56 in the second heat exchange member 32. This annular chamber 56 surrounds the first heat exchange member 30, the interior of which forms a convection chamber 58.

Figure 6:
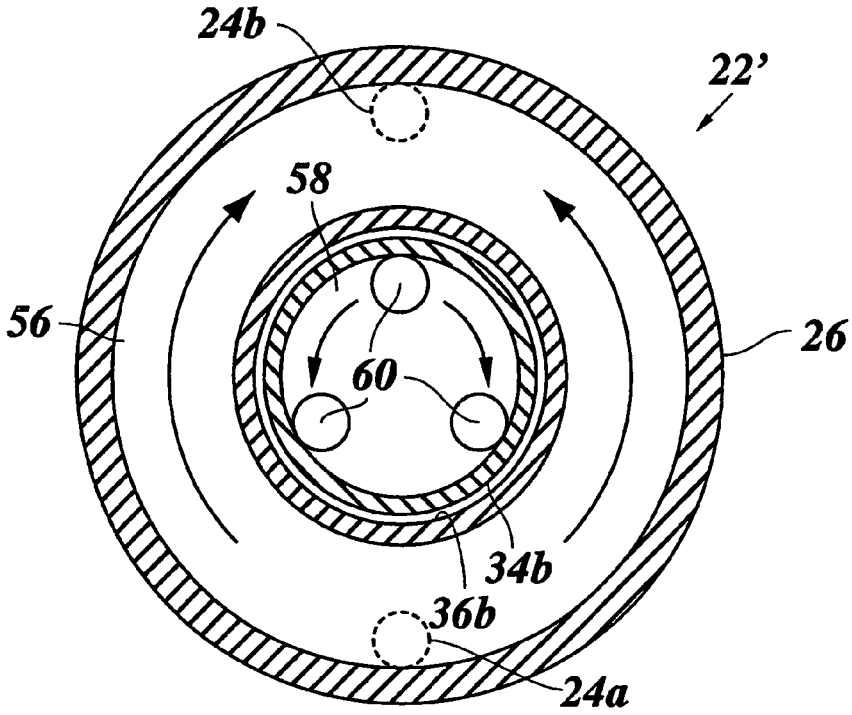
FIG. 6 is a cross-sectional view taken along the line VI-VI in FIG. 5.

The convection chamber 58 is connected to the primary liquid circuit 20 via three axial passages 60, the configuration of which is more clearly shown in FIG. 6. When the liquid in the convection chamber 58 is cooled because it is in thermal contact with the secondary liquid circuit, it will tend to sink down in the convection chamber 58 and flow out through the two lower passages 60 shown in FIG. 6, while new hot liquid is sucked in through the upper passage 60. Thus, a convective circulation of the liquid in the primary liquid circuit 20 is established. This convective flow may be disturbed when the roller 10" rotates at relatively high speed, but will be established again as soon as the roller 10" comes to rest. The arrangement of the three passages 60 assures that, in any angular position of the roller 10", there will always be at least two of the passages 60 having a height difference that induces the convective flow.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A temperature controlled roller system, comprising:

a hollow roller having an annular interior space defined by a stationary axle on which the hollow roller is rotatably mounted by liquid tight bearings;

a primary liquid circuit formed in the annular interior space of the roller and containing a first liquid;

a secondary liquid circuit formed outside of the roller and containing a second liquid, the secondary liquid circuit being defined inside of a stationary part that is stationary relative to the frame, said secondary liquid circuit being enclosed in said stationary part so as to be separated from the roller;

a heat exchanger arranged to bring the primary and secondary liquid circuits into thermal contact with one another, said heat exchanger comprising:

a first heat exchange member that is in thermal contact with the primary liquid circuit and comprises a portion of the stationary axle that projects outwardly from the roller; and a second heat exchange member arranged on the stationary part to be in thermal contact with the secondary liquid circuit; and a temperature control device for controlling the temperature of the second liquid, wherein the first and second heat exchange members form heat transfer surfaces that are opposed to one another to permit heat transfer from one heat exchange member to the other heat exchange member.

2. The system according to claim 1, wherein the heat transfer surfaces of the first and second heat exchange members engage a heat conductive, deformable compensation member interposed therebetween.

3. The system according to claim 1, wherein the first heat exchange member is formed on a rotating component of the roller, and the opposed heat transfer surfaces are symmetric under rotation about the axis of rotation of the roller.

4. The system according to claim 3, wherein at least a portion of the opposed heat transfer surfaces extends in a plane normal to the axis of rotation of the roller.

5. The system according to claim 4, wherein at least a portion of the opposed heat transfer surfaces is cylindrical.

6. The system according to claim 3, wherein at least a portion of the opposed heat transfer surfaces is cylindrical.

7. The system according to claim 1, wherein at least a portion of the opposed heat transfer surfaces extends in a plane normal to the axis of rotation of the roller.

8. The system according to claim 1, wherein at least a portion of the opposed heat transfer surfaces is cylindrical.

9. The system according to claim 1, wherein the primary liquid circuit extends into the first heat exchange member.

10. The system according to claim 1, wherein the temperature control device is a cooling device.

* * * * *